US007151509B2

(12) United States Patent
Massey et al.

(10) Patent No.: US 7,151,509 B2
(45) Date of Patent: Dec. 19, 2006

(54) APPARATUS FOR USE IN PROVIDING WIRELESS COMMUNICATION AND METHOD FOR USE AND DEPLOYMENT OF SUCH APPARATUS

(75) Inventors: Cameron G. Massey, Hawthorne, CA (US); Tom F. Reneau, Long Beach, CA (US); Albert Chang, Fullerton, CA (US)

(73) Assignee: The Boeing Company, Chicago, IL (US)

( * ) Notice: Subject to any disclaimer, the term of this patent is extended or adjusted under 35 U.S.C. 154(b) by 54 days.

(21) Appl. No.: 10/746,833

(22) Filed: Dec. 24, 2003

(65) Prior Publication Data

US 2005/0146484 A1 Jul. 7, 2005

(51) Int. Cl.
*H01Q 15/20* (2006.01)

(52) U.S. Cl. ..... 343/915

(58) Field of Classification Search ..... 343/705, 343/708, 828, 880, 912, 915, 916, 700 MS
See application file for complete search history.

(56) References Cited

U.S. PATENT DOCUMENTS 4,352,112 A * 9/1982 Leonhardt et al. ..... 343/915
5,574,472 A * 11/1996 Robinson ..... 343/915
5,635,946 A * 6/1997 Francis ..... 343/915
6,084,552 A * 7/2000 Robertson et al. ..... 343/753
6,104,358 A * 8/2000 Parker et al. ..... 343/915
6,175,341 B1 * 1/2001 Noir et al. ..... 343/915
6,198,461 B1 * 3/2001 Chieusse et al. ..... 343/915
6,219,009 B1 * 4/2001 Shipley et al. ..... 343/915
6,219,010 B1 * 4/2001 Chieusse et al. ..... 343/915
6,512,496 B1 * 1/2003 Alexeff et al. ..... 343/915
2001/0038357 A1 * 11/2001 Shipley et al. ..... 343/915
2002/0190918 A1 * 12/2002 Stern ..... 343/912

* cited by examiner

*Primary Examiner*—Shih-Chao Chen
*Assistant Examiner*—Minh Dieu A
(74) *Attorney, Agent, or Firm*—Wildman, Harrold, Allen & Dixon, LLP; Gary R. Gillen; Thomas J. Ring

(57) ABSTRACT

An apparatus and method for use in deploying a wireless communication device is provided that includes an antenna element and a reflector secured proximate a first end of the element. The reflector includes a base, and a flexible wall with a first end positioned proximate the base extending away to a second end positioned about the element. The wall can be deformed from an original position to a deformed position where the second end is temporarily positioned proximate the element and released such that the wall returns to the original position. The method includes deforming the reflector from an original position to an altered position where portions of a rim are proximate the element. The reflector is positioned in contact with the communication device, secured in the altered position, maintained in the altered position with a reduced profile, and released such the reflector elastically returns to the original position.

19 Claims, 8 Drawing Sheets

APPARATUS FOR USE IN PROVIDING WIRELESS COMMUNICATION AND METHOD FOR USE AND DEPLOYMENT OF SUCH APPARATUS

FIELD OF THE INVENTION

The present invention relates generally to deployable antennas, and more particularly to deployable antennas having flexible reflective elements.

BACKGROUND OF THE INVENTION

A large helical antenna is an effective means to transmit and receive low frequency, radio frequency (RF) signals from a satellite. Generally, helix antennas with higher gains and greater directivity are accomplished by increasing the number of turns of the helix, which results in an increased antenna length. A gain of an antenna can also be enhanced with a cavity at the base of an antenna. This cavity can also reduce Passive Intermodulation (PIM) products. A compromise between the cavity geometry and the antenna length typically limits or dictates the dimensions of an antenna when the antenna is part of a spacecraft payload because of the desire for an efficient launch configuration. Achieving these antenna dimensions can often adversely limit antenna performance.

The size and geometry of the fairing of the launch vehicle limits the size and shape of antennas and spacecrafts. Antennas with high gain, like helical antennas with large numbers of turns, become more difficult to incorporate with spacecrafts and launch vehicles because of the size and length. Helices with larger reflector cavities need large amounts of cargo area of a launch vehicle. Further, long antennas have to be stabilized with complex and heavy restraining structures, which reduces the amount of payload that can be included in a launch vehicle or increases the cost do to additional power needed to get the payload to orbit.

SUMMARY OF THE INVENTION

The present invention addresses the needs above as well as other needs through the provision of the method, apparatus, and system for use in deploying a wireless communication device. The apparatus can include an antenna element and a reflector. The reflector is secured proximate a first end of the antenna element, wherein the reflector includes a base and a flexible wall. The wall has a first end positioned proximate to the base such that the wall extends from the first end away from the base to a second end positioned at least partially about the antenna element. The wall is flexible such that the wall can be deformed from an original position to a deformed position where points along the second end are temporarily positioned proximate the antenna element and released such that the wall returns to substantially the original position. The antenna element and the reflector form at least part of an antenna, wherein the antenna is secured to a spacecraft in a first position with the reflector in the deformed position such that the reflector has a reduced profile. The antenna can be further secured with the spacecraft in a second position. Following the release of the antenna from the first position, the reflector is released from the deformed position and returns to the original position.

An antenna is provided that comprises a helical antenna element and a generally conical shaped reflector, wherein the reflector includes a flexible wall defining a cavity about the antenna element. The flexible reflector has a first position and a second position, such that a distal end of the wall is deformed and positioned proximate to the antenna element when the reflector is in the second position, and the reflector returns to the first position with the wall tapering away from the element such that the distal end is a maximum distanced from the antenna element. In some embodiments, the reflector includes ribbing. Further, some embodiments deform the reflector such that at least a portion of the distal end of the wall of the reflector is in contact with the antenna element when the reflector is in the second position. The wall can include a reinforced region, wherein the reflector is deformed utilizing the reinforced region.

In some embodiments, a method for use in mounting an antenna to a communication device is provided that comprises: deforming a flexible reflector of the antenna from an original position to an altered position where portions of a rim of the reflector are proximate an antenna element such that the reflector has a reduced profile; securing the reflector in the altered position and maintaining the reflector in the altered position having the reduced profile; and releasing the reflector such the reflector elastically returns to the original position. The maintaining of the reflector in the altered position can include securing a line with the communication device, extending the line from the communication device to a far side of the reflector and securing the line such that the reflector is maintained in the altered position. Further, the releasing of the reflector includes the communication device cutting the line. The method can additionally be implemented such that the extending of the line includes extending the line through an antenna element support structure.

A better understanding of the features and advantages of the present invention will be obtained by reference to the following detailed description of the invention and accompanying drawings which set forth an illustrative embodiment in which the principles of the invention are utilized.

BRIEF DESCRIPTION OF THE DRAWINGS

The above and other aspects, features and advantages of the present invention will be more apparent from the following more particular description thereof, presented in conjunction with the following drawings wherein.

Figure 3:
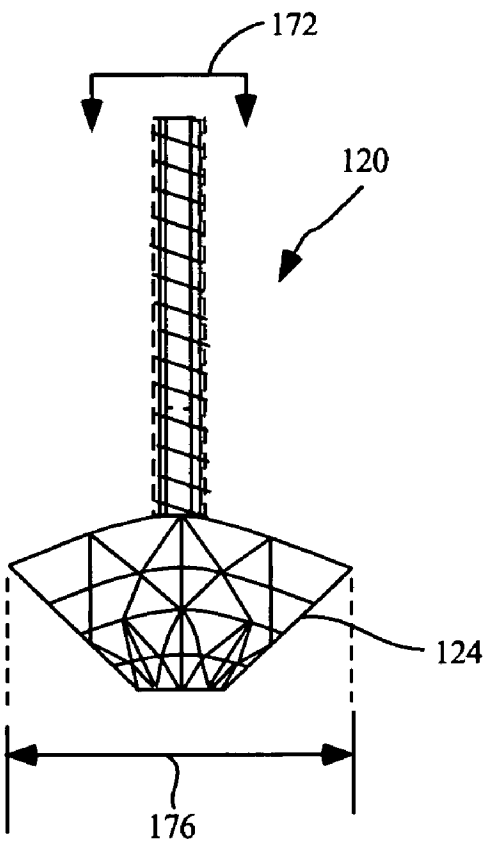
FIG. 3 depicts a side view of the antenna of FIG. 2, where the flexible reflector has been compressed.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are typically not depicted in order to facilitate a less obstructed view of these various embodiments of the present invention.

DETAILED DESCRIPTION

Some embodiments provide apparatuses for use in wireless communication and methods for deploying the apparatuses. These embodiments allow for the deployment of larger transmitting and/or receiving apparatuses, such as antennas providing radio frequency (RF) transmission and/or reception. Deformable reflectors are utilized in these embodiments to allow for the use of larger reflectors with antennas providing improved performance. These embodiments provide for the deployment of antennas that provide better performance for a given antenna length over a wider frequency bandwidth. Additionally, these embodiments can reduce electromagnetic flux resulting in reduced Passive Intermodulation (PIM) products. Still further, these embodiments provide for antennas that have less complex designs and simplified deployment over other large antennas, especially other large helical antennas.

Helical antennas can be utilized in numerous implementations. One implementation includes the transmission and/or reception of wireless signals, such as RF signals from and/or to a communication device, such as a spacecraft and/or an orbiting satellite. For example, a helical antenna can provide wireless communication through single polarization for a spacecraft in a geosynchronous earth orbit (GEO) or medium earth orbit (MEO).

A large helical antenna is an effective means to transmit and receive low frequency, radio frequency (RF) signals, including the UHF (ultra-high-frequency) band. Generally, helix antennas with higher gains and greater directivity are accomplished by increasing the number of turns of the helix, which results in an increased antenna length. Further, an antenna gain can also be enhanced through the use of a cylindrical or conical cavity formed by a reflector at the base of an antenna. An antenna cavity also reduces back radiation, which can mitigate PIM.

When considering a large helical antenna as part of a spacecraft payload, a balancing or trade off between the cavity geometry and the helix length is generally employed to meet the antenna's performance specification while maintaining an efficient launch configuration. Typically, most spacecraft (e.g., a satellite) must be stowed within the fairing of a launch vehicle in order to get the spacecraft into orbit. The size and geometry of the launch vehicle faring limits the configuration and/or geometry of the spacecraft structure and associated components including antennas. This limited spacecraft geometry often requiring large structures like antennas and solar arrays to be constrained into a compact "stowed" configuration. High-gain helices with large numbers of turns become more difficult to stow and stabilize during launch because of their length. Helices with larger reflector cavities inefficiently consume a larger effective volume of the cargo space of a launch vehicle and may also be difficult to stabilize.

A typical high performance helix uses a large number of turns with a relatively small, fixed cavity or backplane that is sized to fit with the spacecraft and in a launch vehicle. These types of long antennas are typically stowed and stabilized with complex restraining structures that can be heavy, as the taller a structure the higher the accelerations induced during launch. For example, a UHF antenna configuration can include a helix 150-inches long with a backplane 35-inches in diameter. This antenna would typically have to be stowed on the nadir of the spacecraft with the tip at least 240-inches from the spacecraft interface, as well as being supported with long deployable struts. An alternative is to collapse, or coil the helix into a more compact structure. The collapsible helix is complex and expensive. In both cases, great care is taken so that the structures do not generate PIM.

Figure 1:
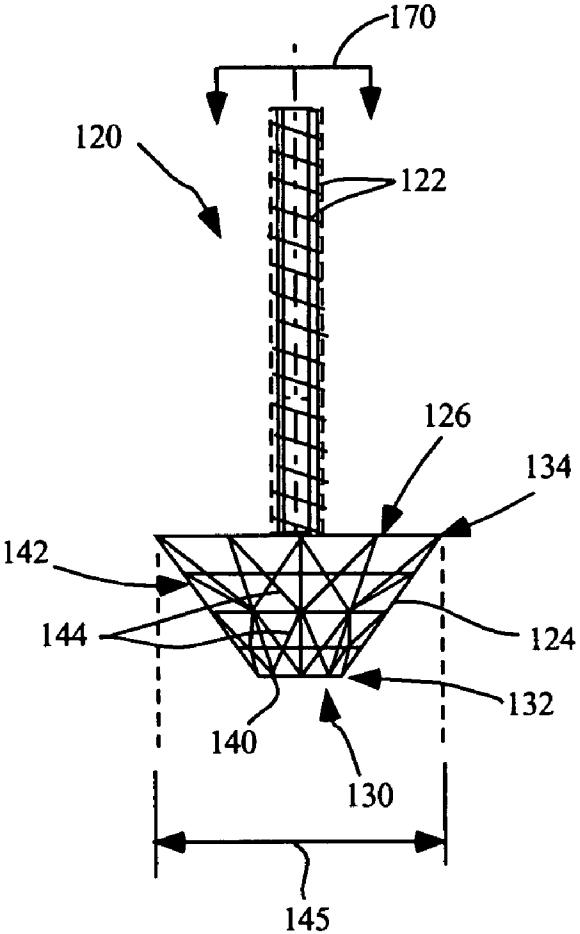
FIG. 1 depicts a simplified perspective view of a helical antenna device according to one embodiment.

FIG. 1 depicts a simplified perspective view of a helical antenna device 120 according to one embodiment. The antenna device includes a helical antenna element 122 that emits and/or receives radio frequency (RF) signals. The antenna device 120 further includes a reflector 124. The reflector is shaped to define a cavity 126 about at least a portion of the antenna element 122. The reflector is positioned proximate a first or coupling end 130 of the antenna element 122. In FIG. 1, the reflector is shown in an original, operational position with the reflector uncompressed.

The reflector can have substantially any shape providing the cavity 126. In some preferred embodiments the reflector has a general conical or frustum shape. However, other shapes can be employed such as parabolic, pyramid or other similar shapes. The reflector in some embodiments includes a base or floor 140 at a small diameter end 132. The reflector 124 is positioned with the small diameter end 132 proximate a coupling end 130 of the antenna element 122. The wall of the reflector extends from the base and tapers away from the antenna element to a distal end or rim 134. In the original position, the rim of the reflector is at a desired maximum distance from the antenna element. The antenna element extends from base 140 of the reflector through the defined cavity 126 and continues to extend out from the second, distal end 134 that forms a large diameter of the frustum shaped reflector.

In some embodiments, the base is rigid and secured with the antenna element 122. The base can be constructed of carbon-fiber composite, aluminum and other similar material. Preferably, the base is constructed of a light weight material to reduce the overall weight of the antenna 120.

The reflector includes one or more walls 142 that extend around or encircle the perimeter of the base. The wall 142 further extends away from the base 140 to the second end 134. The wall can be a single continuous piece or can be assembled from several pieces. The wall is constructed of a flexible material such as carbon-fiber composite, a graphite composite laminate, a graphite epoxy, a coated metalized Kevlar, a mesh material that is metal and/or coated with a metalized material (e.g., coated with gold), and other similar reflective materials. Again, in preferred embodiments, the flexible material of the wall is also light in weight, and in some embodiments can be meshed. Reflector and/or cavity walls 142 that are flexible, repeatable and easily stowed and deployed, allow for the use of high-efficiency helices that can be implemented at low cost and mass.

In some embodiments, the reflector 124 includes supports or ribbing 144. The ribbing provides additional support and rigidity to the reflector. Additionally, the ribbing can provide compression resistance to further enhance spring structure of the reflector to return to substantially the original open position when compression forces are released. The ribbing can be constructed of a material different to that of the reflector, for example, the reflector can be a metalized mesh while the ribbing is a more sturdy metal structure. Alternatively, the ribbing can be constructed of material similar to that of the wall 142, but with a greater thickness than the surrounding parts of the wall. For example, the ribbing and reflector can be made of a graphite epoxy. The thinner wall material and the ribbing 144 can be formed as a continuous piece or can be separate with the ribbing being secured with the wall material. The ribbing can extend along the reflector substantially parallel with the base, perpendicular with the base and/or angled to the base. In some embodiments, the ribbing is arranged in a grid or web pattern about the reflector.

The flexible walls 142 of the reflector 124 of preferred embodiments can be deformed and/or compressed. Compressing two diametrically opposed points along the second end 134 of the wall towards the other and the antenna element 122 allows for a significant reduction in the width 145 of the antenna 120. Reducing the width of the reflector (and thus the antenna) allows the antenna 120 to be more easily stowed within a launch vehicle. Typically, the reflector is constructed to allow significant deformation without damaging the reflector. In several embodiments, the reflector can be deformed such that at least the diametrically opposed points contact the antenna element.

Figure 2:
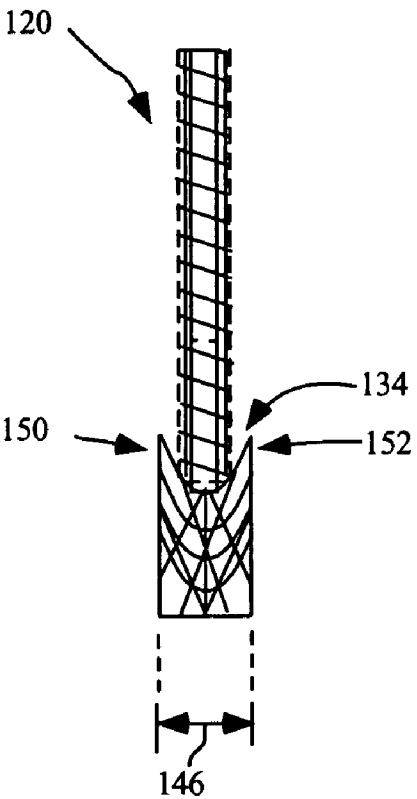
FIG. 2 depicts a perspective view of an antenna, similar to the antenna of FIG. 1, having a flexible reflector where the flexible reflector has been deformed or compressed.

FIG. 2 depicts a perspective view of an antenna 120, similar to the antenna of FIG. 1, having a flexible reflector 124. The reflector has been compressed at diametrically opposed points 150, 152 along the distal end or opening rim 134. The compression provides a significantly reduce width 146. The wall is compressed so that portions of the wall contact the antenna element reducing the width 146. FIG. 3 depicts a side view of the antenna 120 of FIG. 2, again where the flexible reflector 124 has been compressed. The compression causes an elongation of a side width 176.

Figure 4:
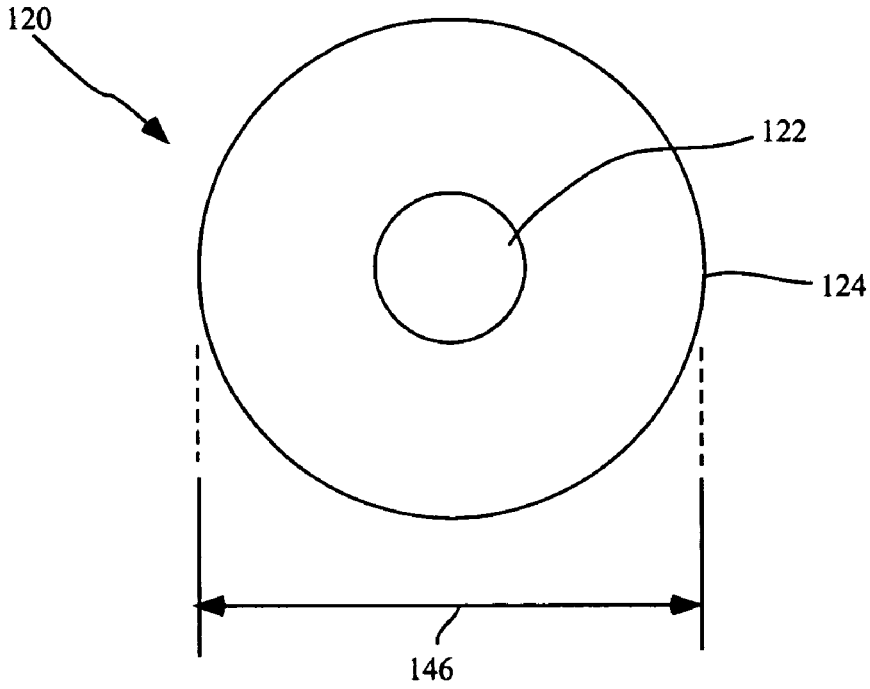
FIG. 4 depicts a simplified block diagram of the antenna viewed along the axis as indicated in FIG. 1.
Figure 5:
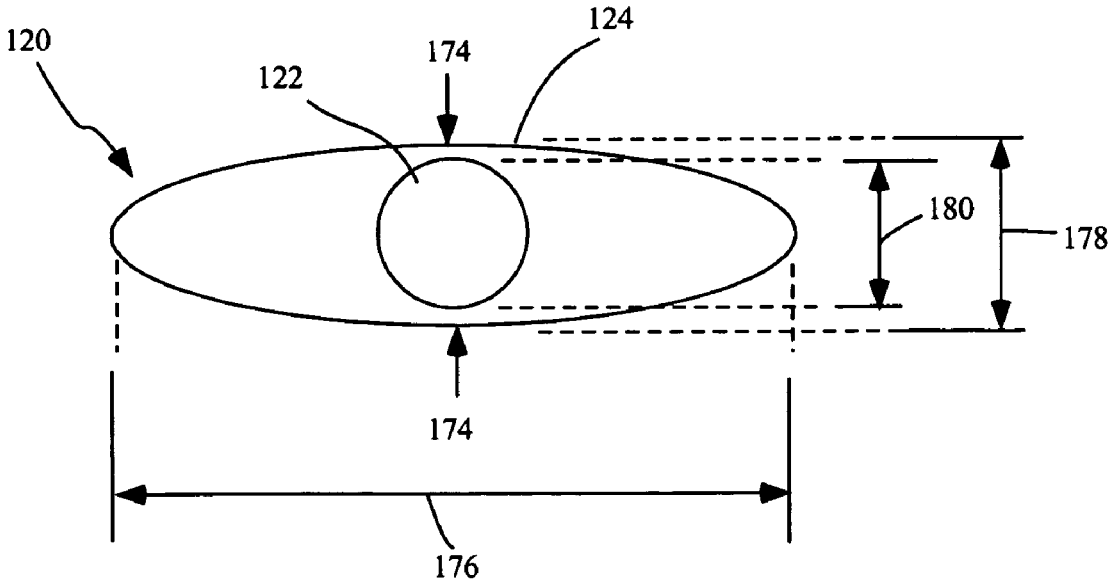
FIG. 5 depicts a simplified block diagram of the antenna viewed along the axis, as indicated in FIG. 3, where a compression force is applied to opposite sides of the reflector.

FIG. 4 depicts a simplified block diagram of the antenna 120 viewed along the axis 170 as indicated in FIG. 1. The cross-section of the reflector 124 is generally circular with a diameter 146. It will be apparent to those skilled in the art that other shapes other than circular can equally be employed without departing from the inventive aspects of the present invention. Similarly, FIG. 5 depicts a simplified block diagram of the antenna 120 viewed along the axis 172, as indicated in FIG. 3, where a compression force 174 is applied to opposite sides of the reflector. The reflector deforms to an altered position with a resulting cross-section having a generally elliptical shape with a width 176 along the major axis that is greater than the diameter 146 of the reflector in the uncompressed condition. However, the profile or width 178 along the minor axis is significantly less than the diameter 146 of the reflector in the uncompressed state, limited by the diameter or width 180 of the antenna element.

Referring to FIGS. 2 and 5, the relatively small profile 178 of the compressed reflector allows the antenna 120 to be positioned in more confined spaces. The small profile additionally allows the antenna to be positioned with a spacecraft in a more secure manor and through simpler means. Additionally, the small profile 178 allows for an antenna with a larger reflector 124 to be utilized with spacecrafts and launch vehicles while optimizing cargo space utilization within a launch vehicle.

Figure 6:
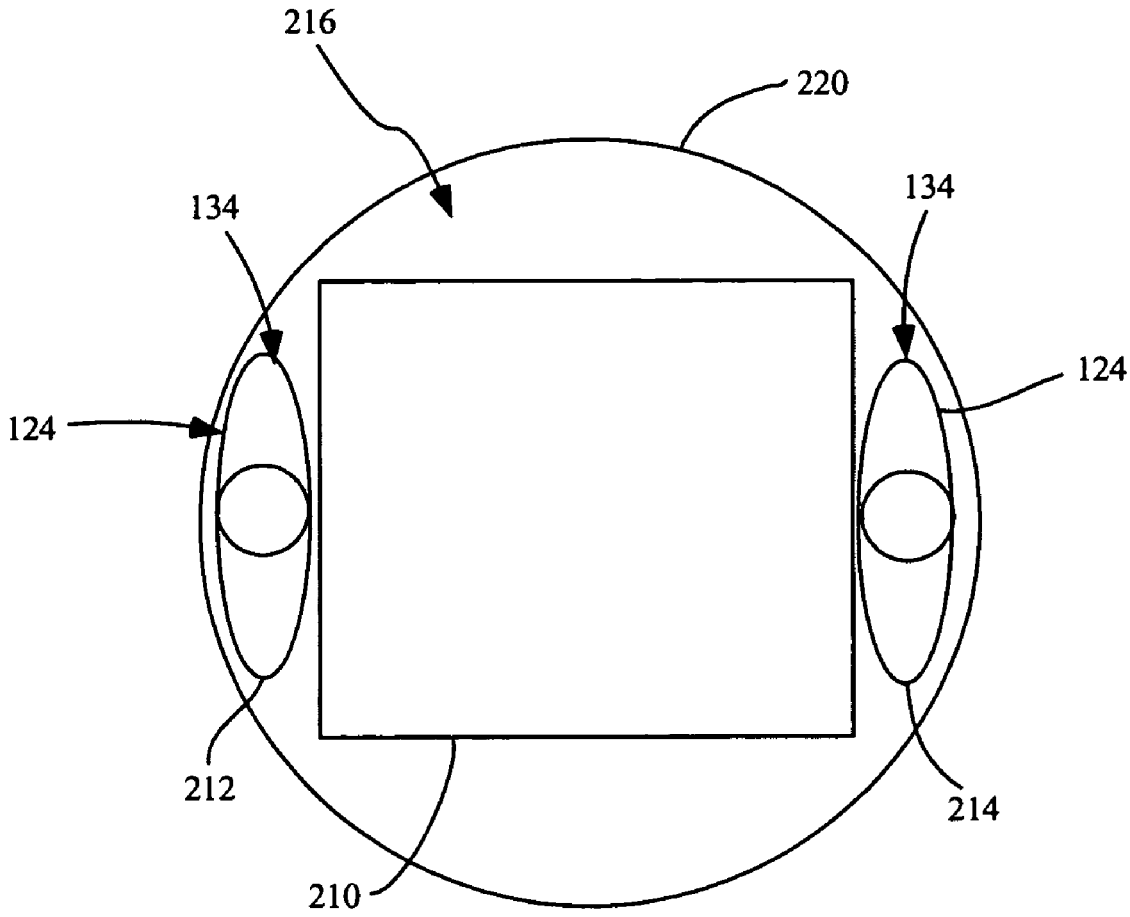
FIG. 6 depicts a simplified block diagram of a cross-sectional view of a launch vehicle housing a communication device and two antennas 212, 214 secured with the communication device.

FIG. 6 depicts a simplified block diagram of a cross-sectional view of a launch vehicle 220 housing a communication device 210, such as a spacecraft, and two antennas 212, 214 secured with the communication device/spacecraft. The spacecraft 210 and antennas are positioned within the fairing 216 of the launch vehicle 220. The reflectors 124 of each antenna 212, 214 are in an altered position where opposite sides of the opening 134 have been compressed towards the other such that the reflectors have small profiles. The antennas are secured along the sides of the spacecraft 210 maximizing the use of space within the fairing 216. For example, the antennas can be deformed with the circular rim 134 of the reflectors pulled in towards the spacecraft into an ellipse shape allowing the spacecraft 210 and antennas 212, 214 to fit within a static envelope of a launch vehicle (e.g., a 4-meter diameter fairing of a launch vehicle). Further, because the antennas are positioned along side the spacecraft, the antennas can be more easily and more securely mounted with the spacecraft.

The reflector walls typically will not contact the fairing walls, while the reflector walls are flexible enough to withstand dynamic contact with the spacecraft 210 as well as the fairing should contact occur. Additionally, by minimizing the height of the helix and allowing for stowage of the antenna(s) along side the spacecraft/launch vehicle interface, launch loads on the antennas 212, 214 are minimized. This allows for lighter designs of both the helix and the restraining and/or securing structure(s) for stowing the antenna within the launch vehicle.

The reflector 124 is preferably constructed of a resilient, repeatable material. As such, once the compression force 174 (see FIG. 5) is released, the reflector springs back to substantially an original, uncompressed position. This springing force can be utilized once the spacecraft is in orbit to at least aid in deploying the antenna. By releasing the compression force, the spring force pushes the reflector open as well as pushing the antenna away from the spacecraft.

Figure 7:
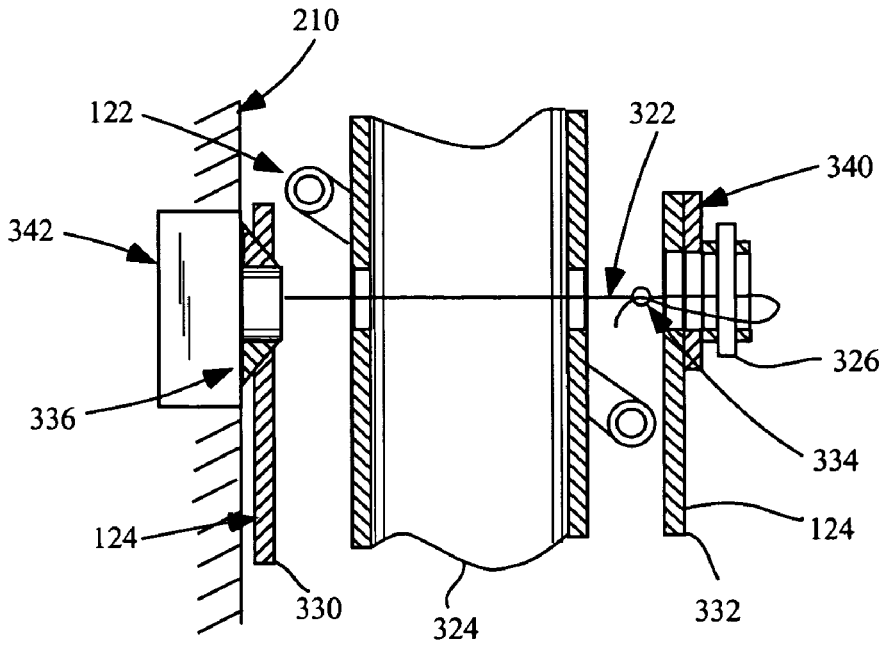
FIG. 7 depicts a simplified cutaway, cross-sectional view of an antenna secured with a spacecraft according to some embodiments.

FIG. 7 depicts a simplified cutaway, cross-sectional view of an antenna 120 secured with a spacecraft 210 according to some embodiments. In these embodiments, the reflector 124 is secured with the space craft in the compressed position such that the reflector walls are maintained in a position adjacent the antenna element 122 and in some embodiments in contact with the element. One or more restraining lines 322 are secured with the spacecraft.

In some embodiment, the spacecraft can include a launch mechanism 342 that secures the line with the spacecraft and releases the line when deploying the antenna. The one or more lines can be substantially any line capable of maintaining the reflector 124 in the compressed state and is preferably non-conductive, such as a dielectric cord, a Kevlar line, a small diameter cable or other similar restraining lines. In these embodiments the line 322 passes through the reflector wall 330 proximate the spacecraft, through an antenna element support structure 324 and is secured with the reflector wall 332 positioned away from the spacecraft. Alternatively, two lines can pass around the antenna support structure to secure with the far wall of the reflector, or other similar configures can be employed.

In some embodiment, the line passes through the far wall 332 and is looped around a portion of the wall or a restraining pin 326 fixed with the far wall 332. The looped line is secured through substantially any method, such as a clip, a knot 334, with the spacecraft or other similar methods. The far wall 332, in some embodiments, includes a reinforced region 340.

Figure 8:
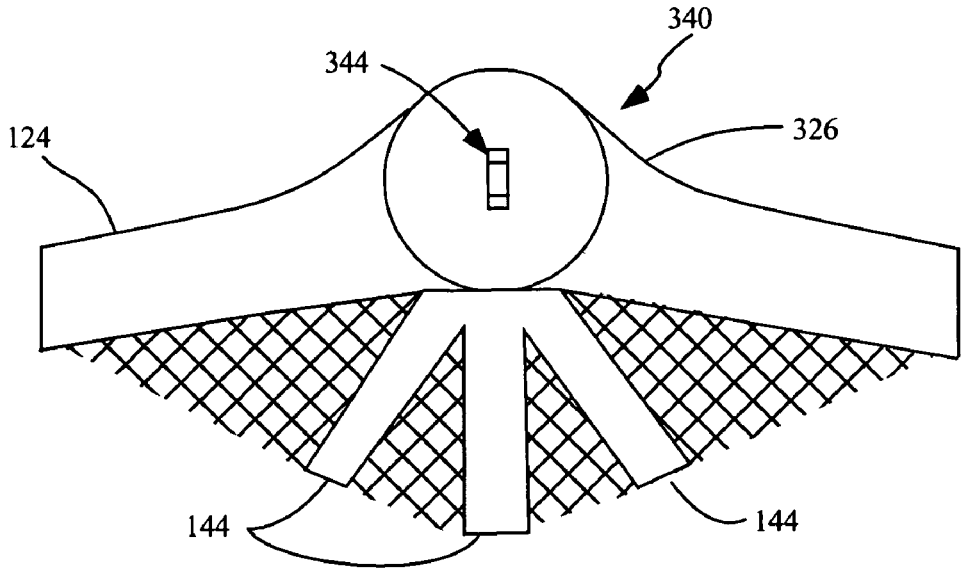
FIG. 8 depicts a simplified prospective view of a portion of the reflector, similar to FIG. 7, with a reinforced region.

FIG. 8 depicts a simplified prospective view of a portion of the reflector 124 with a reinforced region 340 according to some embodiments. The reinforced region can be formed at a junction with ribbing 144 to provide added structural support to the reinforced region. Some embodiments include the restraining pin 326 that extends across a restraining line aperture 344. The restraining line can be passed through the aperture 344, looped around the pin 326 and passed back through the aperture to be secured with the line or the spacecraft.

The reinforced region allows the reflector to withstand the force imposed by the line 322 to maintain the reflector in the compressed position, as well as additional forces that may be applied to the reflector during launch and transport, inadvertent contact (e.g., technician bumping into the antenna) and other similar forces. The reinforced region 340 can be formed as a thicker continuous piece of the reflector, such as a thicker portion of the lightweight, flexible carbon-fiber composite. Some embodiments utilize an additional reinforcement plate that is secured with the reflector to provide the additional support for the restraining pin.

Figure 9:
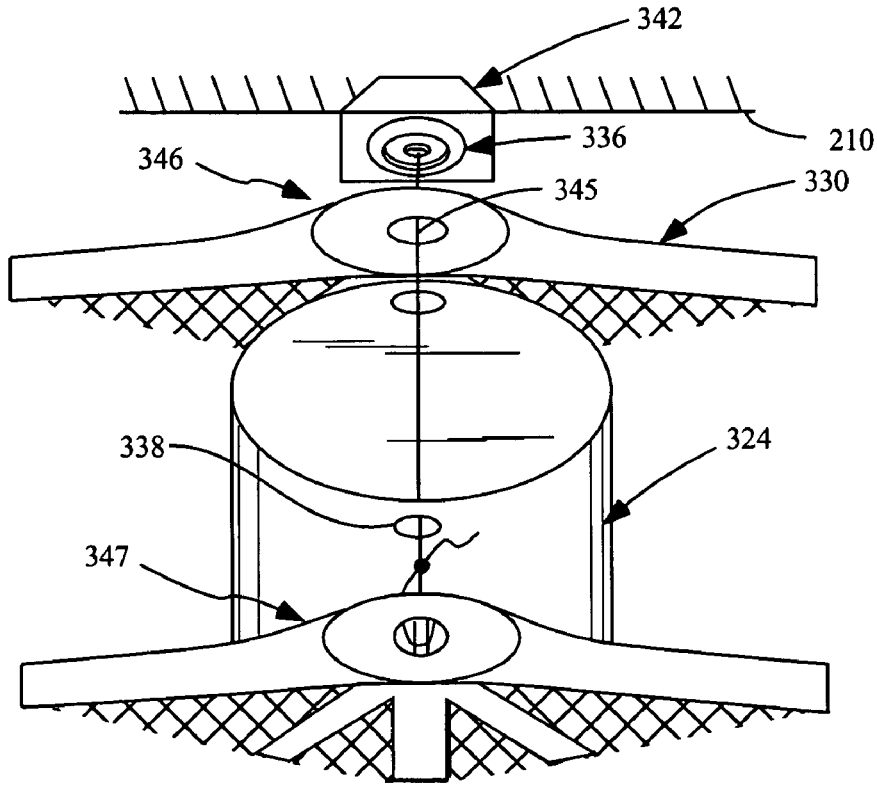
FIG. 9 depicts a partial, isometric view of opposing sides of a reflector in a deformed and/or compressed position.

FIG. 9 depicts a partial, isometric view of opposing sides 346 and 347 of a reflector 124 according to one embodiment. Further, FIG. 9 also shows a cross-section of the antenna element support structure 324 exposing the restraining line 322 extending through the support structure. The line extends from the spacecraft 210 to pass through a near side aperture 345 of the near side wall 330 that is proximate the spacecraft 210. The near side aperture can also be formed as a reinforced region to provide added structural stability and support. The restraining line 322 passes through antenna element support structure 324 and the restraining line aperture 344 in the far side wall 332 to be looped around the restraining pin and secured with, in this embodiment, with the restraining line using a knot or clip 338.

Referring to FIGS. 7 and 9, in these embodiments, the spacecraft 210 can include a cutter, a release or other similar mechanism 342 that cuts, severs or other wise releases the end of the line 322 secured with the spacecraft. For example, the cutter can be a mechanical cutter, a pyrotechnic or other similar cutter. Because of the elastic nature of the reflector, upon cutting or release of the line 322 the reflector returns to the uncompressed, original position applying a spring force that can at least aid in propelling the antenna away from the spacecraft and into a deployed position.

In some embodiments, the spacecraft further includes a mounting or shear cone 336. The shear cone 336 cooperates with the near side aperture 345 to further stabilize the reflector 124 and antenna with the spacecraft. The shear cone can taper as it extends from the spacecraft. The near side aperture 345 is sized to have a diameter greater than a narrower diameter of the shear cone 336 distanced from the spacecraft, and is typically less than a large diameter of the shear cone proximate the spacecraft.

Figure 10:
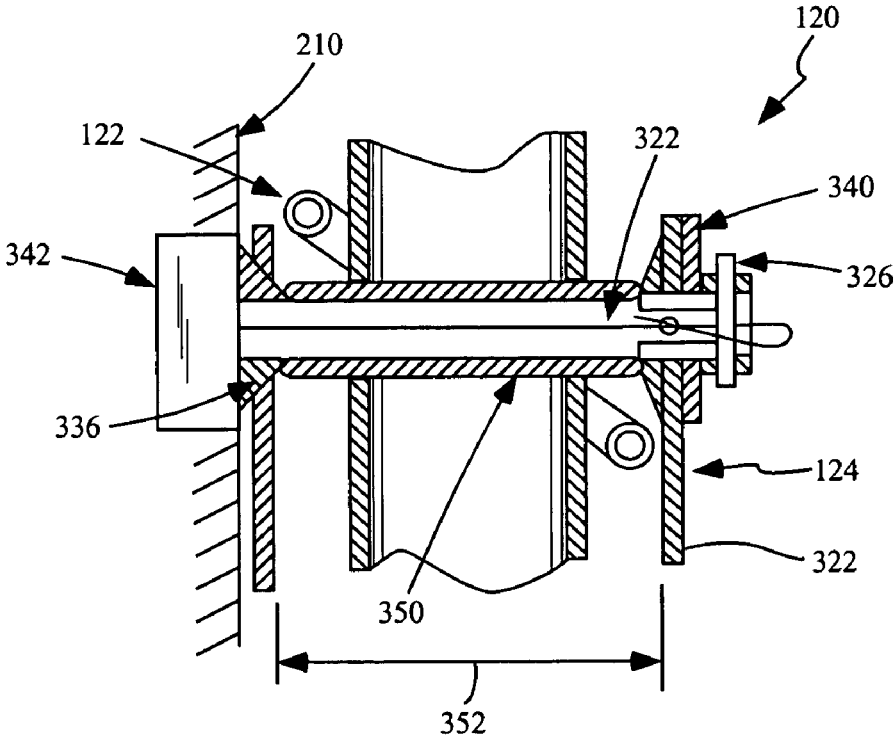
FIG. 10 depicts a simplified cutaway, cross-sectional view of an antenna secured with a spacecraft according to some embodiments.

FIG. 10 depicts a simplified cutaway, cross-sectional view of an antenna 120 secured with a spacecraft 210 according to some embodiments. In this embodiment, a guide support 350 is secured with the antenna element support structure 324. In some embodiments, the guide support extend through the antenna structure and typically has a length 352 that is at least as long as the width 180 of the antenna element 122 (see FIG. 5). Alternatively, the guide support can be fixed with the antenna element support structure. The guide support can be constructed of a non-conductive material, such as Kevlar. In some embodiments, the guide support is constructed of a material that is translucent to or has minimal effects on RF energy.

The guide support 350 protects the antenna element 122 by reducing and/or eliminating contact of the reflector wall 330, 332 with the antenna element while still maintaining the reflector wall adjacent the element. Further, the guide support 350 provides additional rigidity to the reflector 124 and antenna 120 when secured with the spacecraft 210. When the antenna is secured with the spacecraft, the guide support 340 is positioned at one end against the spacecraft, such as against and/or at least partially over the shear cone 336. The far wall 322 of the reflector 124 is secured against and in contact with the second end of the guide support. As such, the reflector wall 322 is more stable and more resistant to forces, while the compression deformation of the reflector is limited to the length of the support guide 350.

In some embodiments, a restraining line 322 is secured with the spacecraft 210 and extends through the guide support 350, and thus through the antenna support structure 324 to the far wall 322 of the reflector 124. The line secures the reflector in the deformed position. For example, the line can be looped around the restraining pin 326 and secured with a knot, clip or other similar means.

Figure 11:
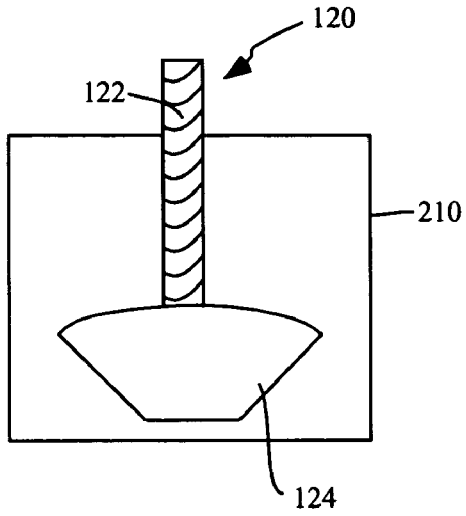
FIG. 11 depicts a simplified block diagram of an antenna mounted and secured with a spacecraft.
Figure 12:
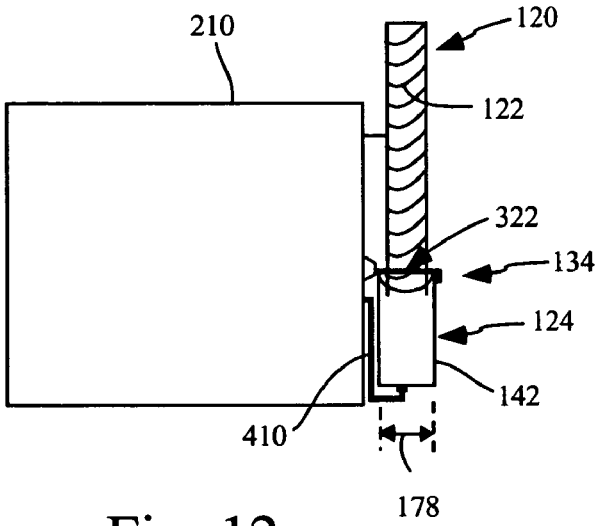
FIG. 12 depicts the spacecraft of FIG. 11 rotated 90°, the antenna mounted with the spacecraft with the reflector wall compressed to an altered or deformed position.

FIG. 11 depicts a simplified block diagram of an antenna 120 mounted and secured with a spacecraft 210 according to one embodiment. FIG. 12 depicts the spacecraft 210 of FIG. 11 rotated 90°, the antenna 120 mounted and secured with the spacecraft, and the wall 142 of the reflector 124 compressed from the original open position into an altered or deformed position such that the antenna has the reduced profile 178. In some embodiments, the reflector 124 is compressed from the original open position such that two points along the second end 134 of the wall 142 are secured proximate the antenna element 122, and in some embodiments in contact with the antenna element. For example, a restraining line 322 can be utilized similar to that shown in FIGS. 7 and 10 to maintain the reflector in the compressed, altered position.

Figure 13:
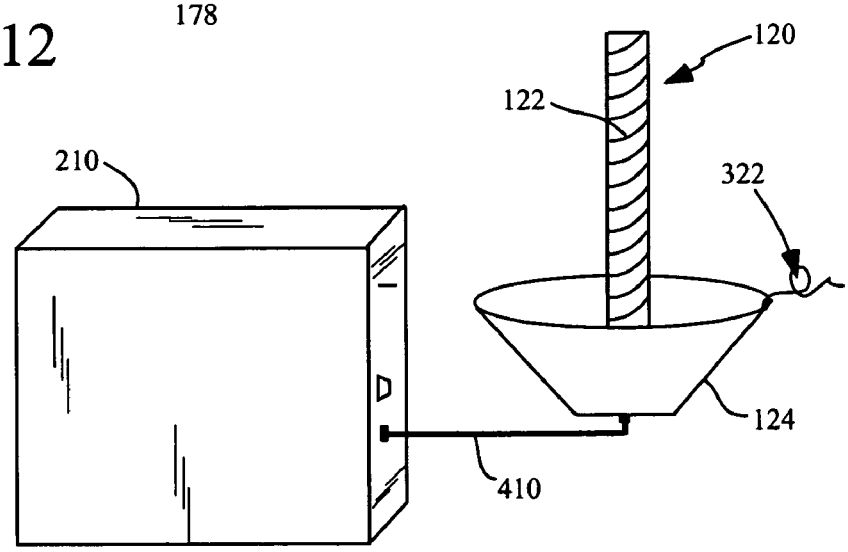
FIG. 13 depicts a simplified perspective view of the spacecraft of FIGS. 11–12 with the antenna in a deployed position.

FIG. 13 depicts a simplified perspective view of the spacecraft 210 of FIGS. 11–12 with the antenna 120 in a deployed position. The restraining line 322 (see FIG. 12) has been cut by the spacecraft and remains fixed with the reflector 124. In some embodiments, the potential energy of the compressed reflector, the reflector springs outboard away from the spacecraft to at least aid in deploying the antenna. In some embodiments, the antenna utilizes the potential energy of the reflector wall to deploy the antenna rather than mechanisms, which reduces implementation risk and cycle time.

Because the line 322 is typically formed from a dielectric material, the presence of the line does not adversely affect the communication performance of the antenna 120. The line is prevented from contacting or entangling with the antenna element and/or other structures of the spacecraft 210, because the line is secured at the outer edge perimeter of the reflector and the radius of the reflector opening 134 is typically larger than the reduced profile 178 of the antenna when the reflector is in the altered position.

The antenna can be secured with the spacecraft 210 through a deployment arm 410. Electronic coupling between the spacecraft and the antenna can be achieved through the deployment arm and/or wiring can be included within or along the deployment arm that electrically couples with the antenna. The electronic coupling allows the antenna to receive communications from the spacecraft to be wirelessly transmitted, and/or to forward wireless communications to the spacecraft that were received from a remote transmitting device (such as a transmitting station on earth). It will be apparent to those skilled in the art that other electronic coupling and/or communication can be implemented to provide communication between the spacecraft 210 and the antenna 120.

Figure 14:
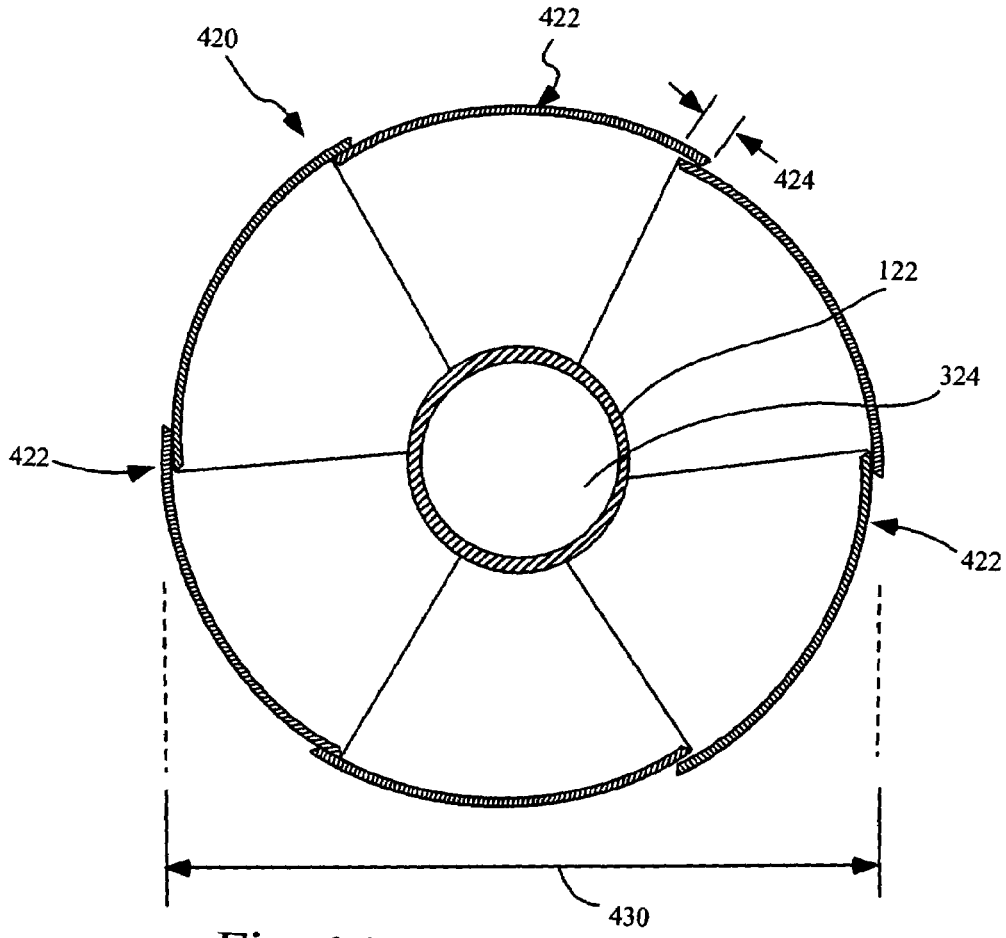
FIG. 14 depicts a simplified block diagram an antenna with a multi-wall reflector in the original, open position.

FIG. 14 depicts a simplified block diagram of an antenna 120 with a multi-wall reflector 420 in the original, open position. The reflector includes a plurality of walls 422, where the walls are positioned staggered around the antenna element 122 and antenna element support structure 324. Each wall overlaps 424 a neighboring wall, or is adjacent to the neighboring wall without overlapping. The walls are positioned about the base 130 and extending from the base to a second, distal end 134. The plurality of walls forms the cavity 126 from which the antenna element 122 extends. In one embodiment, the walls each include a bend 512 such that the base is formed from the plurality of walls. Alternatively, the walls are secured with the base such that they resist compression in towards the antenna element. This resistive force can be due to the bonding of the walls with the base, spring structures secured with the base and the walls or other similar means. In the original and/or deployed position, the reflector has a preferred original diameter 430 utilized when the antenna is receiving or radiating wireless signals. The walls can be deformed from an original open position to a collapsed position where the opening formed at the second end has a significantly reduced diameter.

Figure 15:
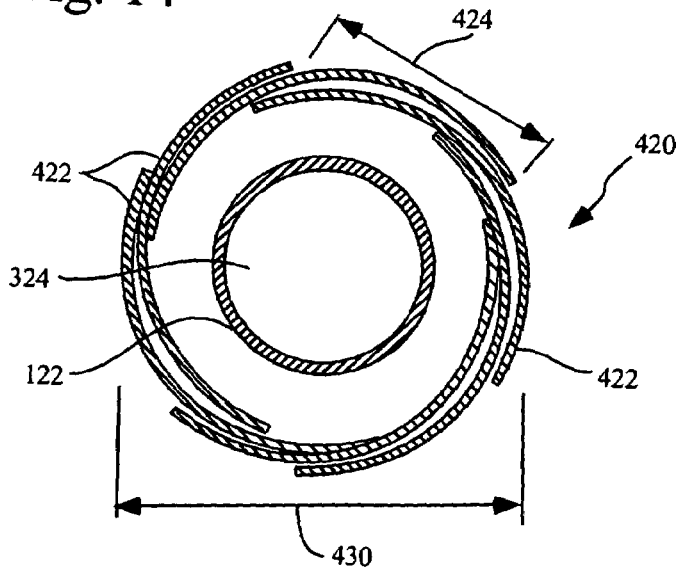
FIG. 15 depicts a simplified block diagram of the antenna of FIG. 14 with the multi-wall reflector in the altered and/or collapsed position.

FIG. 15 depicts a simplified block diagram of the antenna 120 of FIG. 14 with the multi-wall reflector 420 in the altered and/or collapsed position. The multiple walls 422 are forced in towards the antenna element 122 such that the overlap 424 of each wall is increased and the diameter 430 of the opening at the second end is reduced resulting in a reduced profile. In one embodiment, a cord or string 432 is drawn in around the walls collapsing the walls in towards the antenna element. The cord can secure with a spacecraft and be cut by the spacecraft. In the altered position, the plurality of walls are positioned proximate and/or in contact with the antenna element 122. The plurality of walls couple with the base and elastically resist collapsing into the deformed configurations.

Figure 16:
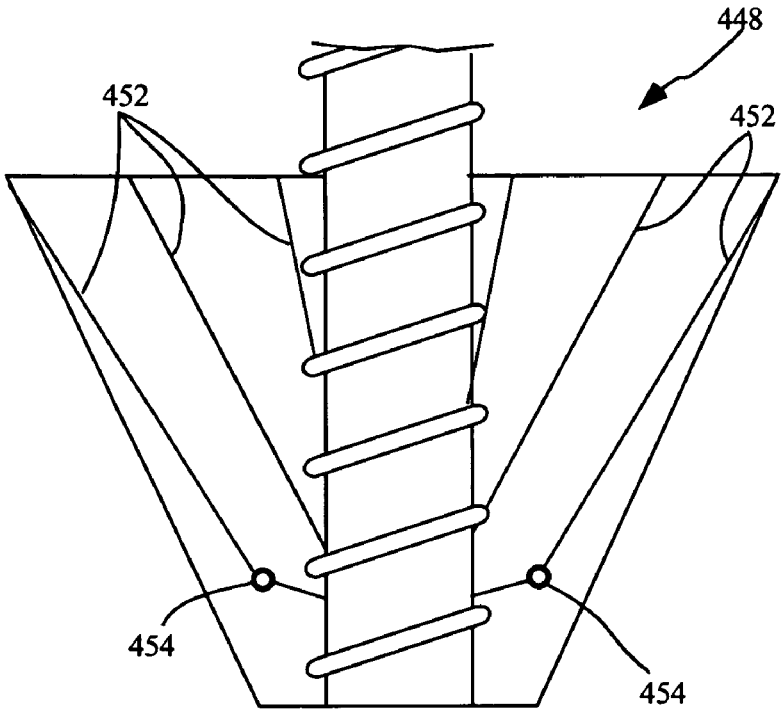
FIG. 16 depicts a simplified cross-sectional view of an alternate embodiment of an antenna.
Figure 17:
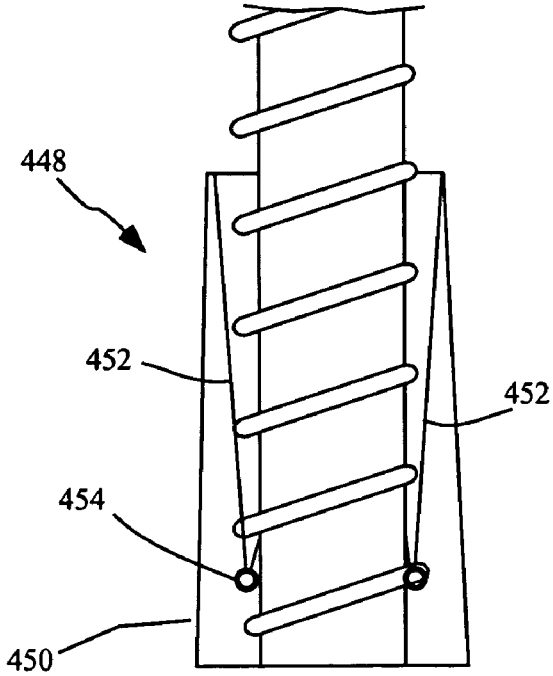
FIG. 17 depicts the reflector of FIG. 16 in the altered, collapsed position with the hinged supports bent at the hinges.

FIG. 16 depicts a simplified cross-sectional view of an alternate embodiment of an antenna 448. The reflector 450 includes a plurality of hinged supports 452. The hinged supports can bend at the hinges 454 causing the reflector to deform. FIG. 17 depicts the reflector 450 of FIG. 16 in the altered, collapsed position with the hinged supports 452 bent at the hinges 454. In collapsing the reflector 450 at the hinges, the profile 178 of the reflector is significantly reduced. In some embodiments, the hinged supports operate similar to an umbrella or other similar structures that allow the collapsing of the structure.

These embodiments provide for the implementation and utilization of larger, lightweight cavities/reflectors that provide better performance for a given antenna length over a wider frequency bandwidth. Further, the cavity wall(s) reduce electromagnetic flux to the side and behind the antenna, which can reduce PIM. Additionally, these embodiments provide antennas of lightweight designs with improved RF performance. These embodiments provide for less complex designs and deployment than other large antennas, especially other large helices, and can be implemented with lower risk than designs with large deployable support structures or uncoiling/unfurling elements. Further, the flexible reflector allows for a reduced profile that is utilized to provide a more secure attachment with a spacecraft for launch and deployment. Still further, the reduced profile achieved by deforming the flexible reflector optimizes the use of cargo space within a launch vehicle.

While the invention herein disclosed has been described by means of specific embodiments and applications thereof, numerous modifications and variations could be made thereto by those skilled in the art without departing from the scope of the invention set forth in the claims.

What is claims is:

1. An apparatus for use in providing wireless radio frequency communication, comprising:

an antenna element;

a reflector secured proximate a first end of the antenna element, wherein the reflector includes a base and a flexible wall, the wall having a first end positioned proximate the base such that the wall extends from the first end away from the base to a second end positioned at least partially about the antenna element; and the wall is flexible such that the wall can be deformed from an original position to a deformed position where points along the second end are temporarily positioned proximate the antenna element, and released such that the wall returns to substantially the original position.

2. The apparatus of claim 1, wherein the antenna element and the reflector form at least part of an antenna, and further comprising:

a spacecraft, wherein the antenna is secured with the spacecraft in a first position with the reflector in the deformed position such that the reflector has a reduced profile.

3. The apparatus of claim 2, wherein the antenna is further secured with the spacecraft in a second position following the release of the antenna from the first position, where the reflector is released from the deformed position and returned to the original position.

4. The apparatus of claim 2, further comprising:

a restraining line having a first end and a second end, wherein the restraining line is secured at the first end of the line with the spacecraft and secured proximate the second end of the line with the reflector such that the restraining line maintains the reflector in the deformed position.

5. The apparatus of claim 4, wherein the spacecraft includes a cutter that cuts the restraining line releasing the reflector.

6. An antenna, comprising:

a helical antenna element;

a generally conical shaped reflector, wherein the reflector includes a flexible wall defining a cavity about the antenna element; and the flexible reflector has a first position and a second position, such that a distal end of the wall is deformed and positioned proximate the antenna element when the reflector is in the second position, and the reflector returns to the first position with the wall tapering away from the element such that the distal end is a maximum distanced from the antenna element.

7. The antenna of claim 6, wherein the reflector includes ribbing.

8. The antenna of claim 6, wherein at least a portion of the distal end of the wall is in contact with the antenna element when the reflector is in the second position.

9. The antenna of claim 6, wherein the wall includes a reinforced region, wherein the reflector is deformed utilizing the reinforced region.

10. The antenna of claim 6, further comprising:

an antenna element support structure positioned proximate the antenna element that at least partially supports the antenna element; and a guide support extending through the antenna element support structure.

11. The antenna of claim 10, wherein the guide support is positioned such that at least a portion of the reflector is in contact with the guide support when in the second position.

12. The antenna of claim 6, further comprising:

a guide support fixed with an antenna support structure such that the reflector contacts the guide support when in the second position.

13. A method for use in mounting an antenna to a communication device, comprising:

deforming a flexible reflector of the antenna from an original position to an altered position where portions of a rim of the reflector are proximate an antenna element such that the reflector has a reduced profile;

securing the reflector in the altered position and maintaining the reflector in the altered position having the reduced profile; and releasing the reflector such that the reflector elastically returns to the original position.

14. The method of claim 13, wherein the maintaining the reflector in the altered position includes:

securing a line with the communication device;

extending the line from the communication device to a far side of the reflector; and securing the line such that the reflector is maintained in the altered position.

15. The method of claim 14, wherein the releasing the reflector includes cutting the line.

16. The method of claim 14, wherein the extending the line includes extending the line through an antenna element support structure.

17. The method of claim 14, wherein the securing the antenna with the communication device includes securing the antenna along a side of the communication device.

18. The method of claim 17, further comprising:

reducing the unusable cargo space of a launch vehicle including positioning the communication device with the secured antenna in the altered position within a launch vehicle such that the reflector is proximate a fairing of the launch vehicle.

19. The method of claim 13, wherein the securing the reflector includes securing the reflector against a guide support.

* * * * *